US009909373B2

(12) United States Patent
Koltiska

(10) Patent No.: US 9,909,373 B2
(45) Date of Patent: Mar. 6, 2018

(54) WELL ROD STRING PENETRATION ADJUSTMENT APPARATUS AND METHOD

(71) Applicant: Justin Koltiska, Sheridan, WY (US)

(72) Inventor: Justin Koltiska, Sheridan, WY (US)

( * ) Notice: Subject to any disclaimer, the term of this patent is extended or adjusted under 35 U.S.C. 154(b) by 59 days.

(21) Appl. No.: 14/621,242

(22) Filed: Feb. 12, 2015

(65) Prior Publication Data

US 2016/0237765 A1 Aug. 18, 2016

(51) Int. Cl.
*E21B 19/00* (2006.01)
*E21B 43/12* (2006.01)

(52) U.S. Cl.
CPC ..... *E21B 19/00* (2013.01); *E21B 43/127* (2013.01)

(58) Field of Classification Search
CPC ..... E21B 43/04; E21B 19/00; E21B 19/02; E21B 43/127; E21B 19/06; E21B 19/006
See application file for complete search history.

(56) References Cited

U.S. PATENT DOCUMENTS

| | | | | |
|---|---|---|---|---|
| 4,467,871 | A | 8/1984 | Rollwitz | |
| 7,578,352 | B2 * | 8/2009 | Hallonquist | E21B 19/086 166/383 |
| 7,766,080 | B2 * | 8/2010 | Khehra | B66F 3/24 166/77.4 |
| 2014/0205466 | A1 * | 7/2014 | Best | F04B 47/00 417/46 |

FOREIGN PATENT DOCUMENTS

| | | |
|---|---|---|
| CN | 201428436 Y | 3/2010 |
| CN | 203127849 U | 8/2013 |

* cited by examiner

*Primary Examiner* — D. Andrews
*Assistant Examiner* — Manuel C Portocarrero
(74) *Attorney, Agent, or Firm* — Peter J. Timbers

(57) ABSTRACT

An apparatus and method to raise and lower a well rod string is provided. The apparatus includes a top plate that engages a temporary polished rod clamp and lifting means and legs affixed to a well head. The lifting means provide elevation of the well rod string to adjust the position of the polished rod clamp relative to the carrier bar of a pumping unit.

20 Claims, 22 Drawing Sheets

WELL ROD STRING PENETRATION ADJUSTMENT APPARATUS AND METHOD

FIELD OF THE INVENTION

This invention relates generally to an apparatus and method to adjust the well rod string penetration depth into a water, oil or gas well.

BACKGROUND OF THE INVENTION

Water, oil and gas pump operators often are in need of adjusting the depth of penetration of the well rod string into the well. Often the well rod string extends too far into the well, which resulting in a situation wherein the well rod string must be raised. Alternatively, the well rod string does not extend far enough into the well, resulting in a situation wherein the well rod string must be lowered.

To accomplish adjustment of the well rod string penetration depth into the well it is currently necessary to configure the pumping unit into multiple positions and adjust the well polished rod attachment to the polished rod clamp at the location of the carrier bar of the pumping unit. The art of maneuvering the pumping unit into positions to allow adjustment of the polished rod clamp is timely and often dangerous. Thus, the time and safety considerations currently required to adjust the penetration depth of well rod string have created a need for industry to quickly and easily and safely adjust the polished rod penetration depth.

SUMMARY OF THE INVENTION

Accordingly, it is an object of embodiments of the present invention to provide an apparatus and method to adjust the penetration depth of the well rod string by attachment of the apparatus to the polished rod.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims. To achieve the foregoing and other objects, and in accordance with the purposes of the present invention, as embodied and broadly described herein, the invention comprises an apparatus for adjusting vertically a well rod string's penetration into a well by temporary attachment or the apparatus at a well's polished rod above a stuffing box at a well head, said apparatus comprising a top plate, a lifting means, a leg stabilizing plate and at least two or more legs, said top plate having a top surface, a bottom surface, and a void space that is larger than the polished rod, the bottom surface of the top plate in contact with and disposed above the lifting means, said top plate disposed perpendicular to said polished rod, said lifting means comprising a top portion and a bottom portion, said lifting means top portion in contact with the bottom surface of the top plate and said lifting means bottom portion in contact with the leg stabilizing plate, said leg stabilizing plate having a top section and a bottom section, said leg stabilizing top section in contact with the bottom portion of the lifting means and said leg stabilizing bottom section in contact with the at least two or more legs, each of said at least two or more legs comprises a top segment and a bottom segment, each of said at least two or more legs top segment are adapted for attachment to the leg stabilizing bottom section and each of said at least two or more legs bottom segments are adapted for attachment at the well head.

In another embodiment, the invention further comprises an apparatus for adjusting vertically a well rod string's penetration into a well by temporary attachment of the apparatus at a well's polished rod above a stuffing box at a well head, said apparatus comprising a temporary polished rod clamp, a top plate, a lifting means, a leg stabilizing plate and at least two or more legs, said temporary polished rod clamp having a inner surface adapted for securing attachment to the polished rod, a top, a bottom, and an outer surface, said top plate having a top surface, a bottom surface, and a void space that is larger than the polished rod and smaller than the bottom surface of the temporary polished rod clamp, the top surface of the top plate in contact with the bottom surface of the temporary polished rod clamp, the bottom surface of the top plate in contact with and disposed above the lifting means, said top plate disposed perpendicular to said polished rod, said lifting means comprising a top portion and a bottom portion, said lifting means top portion in contact with the bottom surface of the top plate and said lifting means bottom portion in contact with the leg stabilizing plate, said leg stabilizing plate having a top section and a bottom section, said leg stabilizing top section in contact with the bottom portion of the lifting means and said leg stabilizing bottom section in contact with the at least two or more legs, each of said at least two or more legs comprising a top segment and a bottom segment, each of said at least two or more legs top segment adapted for attachment to the leg stabilizing bottom section and each of said at least two or more legs bottom segment adapted for attachment to the stuffing box at the well head.

In another embodiment, the invention comprises a method to raise or lower a well rod string having a polished rod and a polished rod clamp resting atop the carrier bar and attached to the polished rod, said method comprising the steps of lowering a horsehead of a pumping unit, affixing an apparatus comprising a temporary polished rod clamp, a top plate, a lifting means, a leg stabilizing plate and legs to the top portion of a well head, attaching the temporary polished rod clamp to the polished rod, raising the temporary polished rod clamp, adjusting the position of the polished rod clamp is affixed to the polished rod, lowering the lifting means and removing the apparatus from atop the well head.

Benefits and advantages of the present invention include, but are not limited to, providing a means to adjust the amount of penetration of a polished rod into a well via a lifting means and a plate. Further the invention includes a method to engage the polished rod and adjust its connection to the carrier bar and polished rod clamp.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
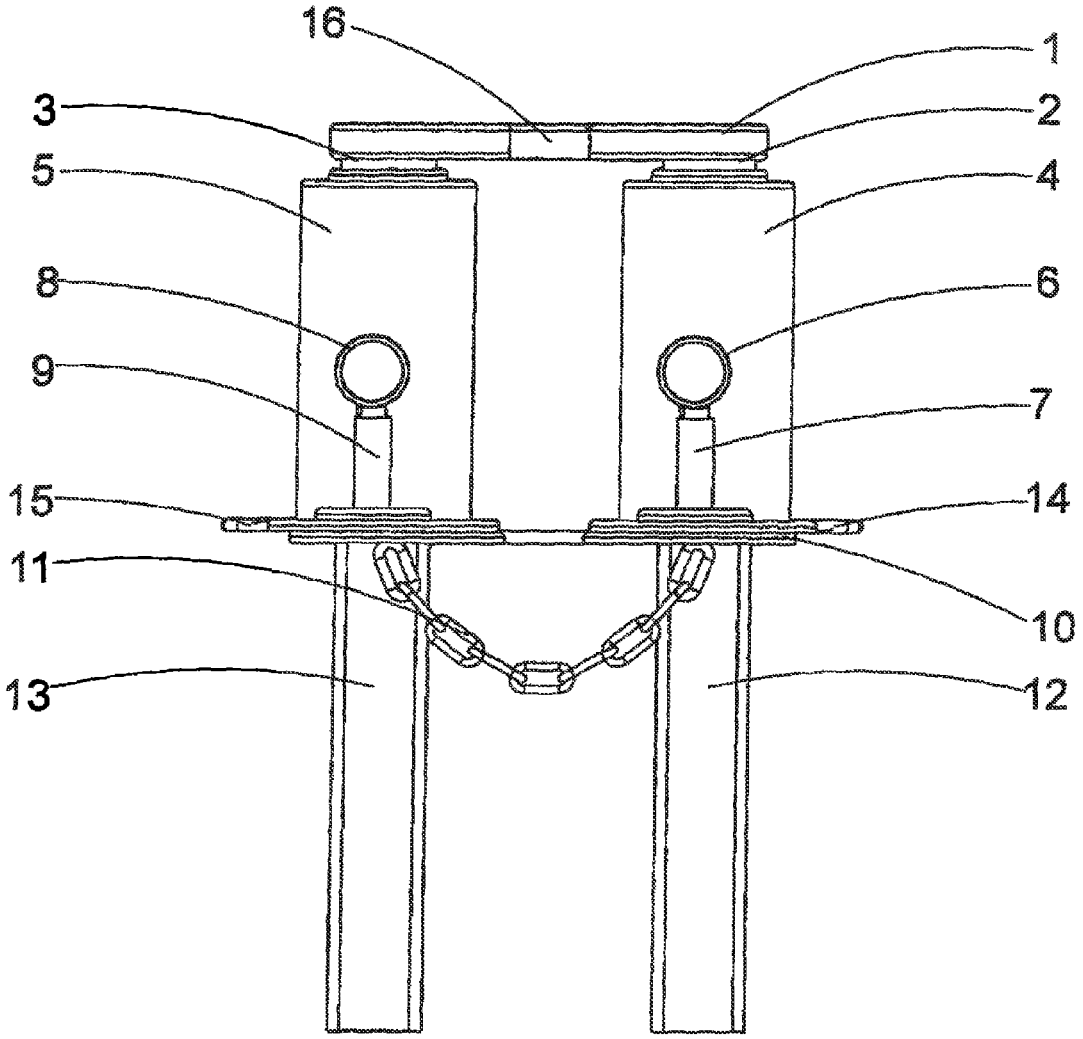
FIG. 1 illustrates a front planar view of one embodiment of the present invention.

Reference will now be made in detail to embodiments of the invention, examples of which are illustrated in the accompanying drawings. Throughout the following detailed description, the same reference characters refer to the same or similar elements in all figures.

FIG. 1 shows a front planar view of one embodiment of the instant invention. Specifically, the top plate 1 is shown and a void space 16 is also shown. The bottom of the top plate one is in contact with the top portion of the lifting 1 means. In this case, the lifting means comprises left lifting jack 4 and right lifting jack 5. The lifting means comprise any lifting means known in the lifting arts, including hydraulic jacks and pumps, pneumatic jacks and pumps and electric jacks and pumps. Also depicted in FIG. 1 are the left jack pump socket 6 and left jack base 7 and right jack pump socket 8 and right jack base 9. Right carrying handle 15 and left carrying handle 14 are also depicted.

Figure 2:
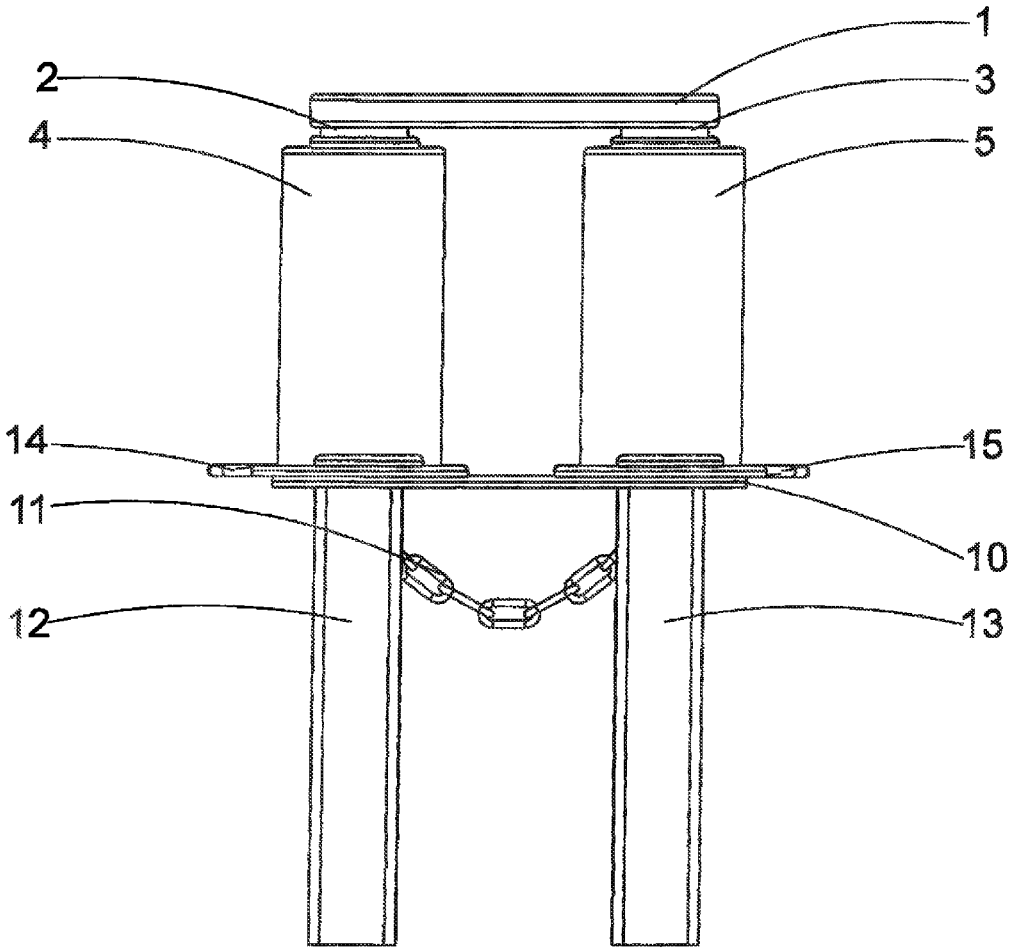
FIG. 2 illustrates a back planar view of one embodiment of the present invention.

The top portion 2 of the left lifting jack 4 is in contact with the bottom surface of the top plate 1. Similarly, the top portion 3 of the right lifting jack 5 is also in contact with the bottom surface of the top plate 1. The bottom portions of lifting jack 4 and lifting jack 5 are in contact with the top section of the leg stabilizing plate 10. The leg stabilizing plate bottom section is in contact with the top segment of the left leg 12 and the top segment of the right leg 13 that are adapted for attachment to the stuffing box, not depicted. FIG. 1 also shows the safety chain 11 hung in place after the invention is installed atop the stuffing box. This ensures that the invention will not be dismounted while in use, FIG. 2, back-side view of one embodiment of the present invention, depicts the top portion 2 of the left lifting jack 4 is in contact with the bottom surface of the top plate 1 and the top portion 3 of the right lifting jack 5 is also in contact with the bottom surface of the top plate 1. The bottom portions of lifting jack 4 and lifting jack 5 are in contact with the top section of the leg stabilizing plate 10. The leg stabilizing plate bottom section is in contact with the top segment of the left leg 12 and the top segment of the right leg 13 that are adapted for attachment to the stuffing box, not depicted. FIG. 2 also shows the safety chain 11 hung in place after the invention is installed atop the stuffing box as well as the right handle 15 and left handle 14.

Figure 3:
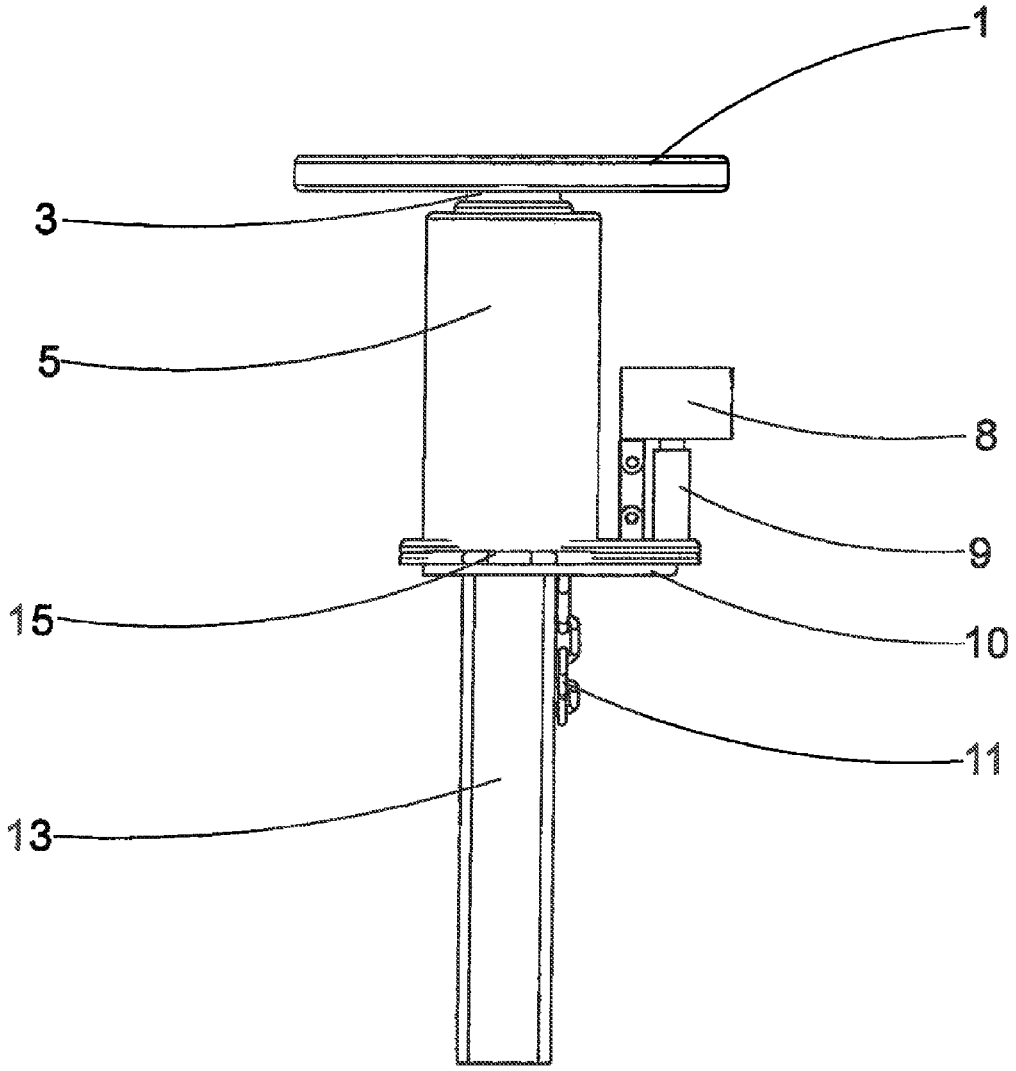
FIG. 3 illustrates a right side planar view of one embodiment of the present invention.

FIG. 3 depicts a right-side planar view of one embodiment of the instant invention. The bottom surface of the top plate 1 is in contact with the top portion 3 of the right side lifting jack 5. The bottom portion of the lifting jack 5 is in contact with the top section of the stabilizing plate 10 and the bottom section of the stabilizing plate 10 is in contact with the right leg 13. The right side right jack pump socket 8, the right jack base 9, the right side carrying handle 15 and safety chain 11 are also depicted.

Figure 4:
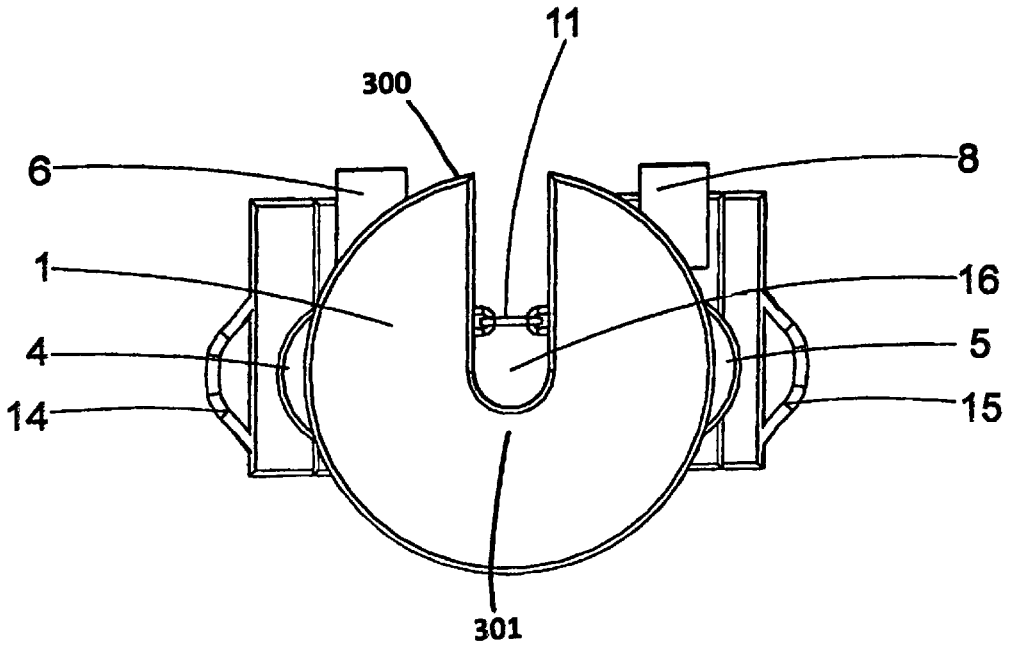
FIG. 4 illustrates a top planar view of one embodiment of the present invention.

FIG. 4 is a top down planar view of one embodiment of the instant invention. The void space 16 in the top plate 1 is shown. The top plate 1 has a top plate middle portion 301. The length of the void space 16 comprises the distance from the top plate middle portion to the outer perimeter 300 of the top plate 1, and the width of the void space comprises the distance between the two opposing internal sides of the length of the void space. The width of the void space 16 is perpendicular to the length of the void space 16. The non-depicted polished rod has a width that is less than the width of the void space. The top portion of the left lifting jack 4 and the top portion of the right lifting jack 5 and the corresponding left pump jack socket 6 and right pump jack socket 8 are depicted. Also, right carrying handle 15, the left carrying handle 14 and the safety chain 11 are depicted.

Figure 5:
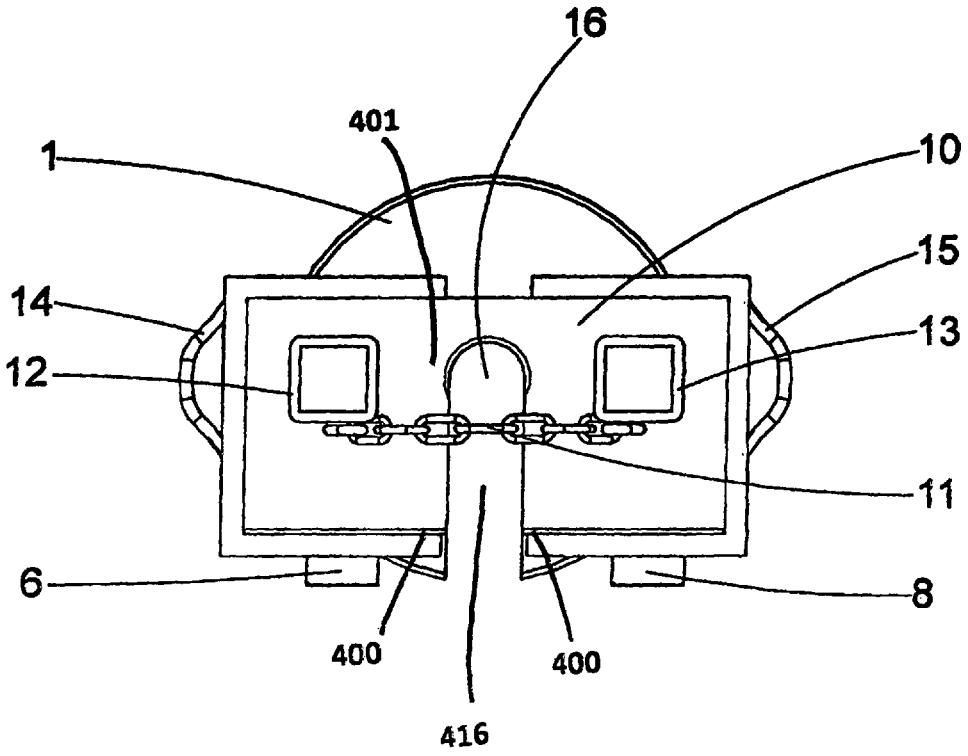
FIG. 5 illustrates a bottom planar view of one embodiment of the present invention.

FIG. 5 is a bottom up planar view of one embodiment of the instant invention. The void space 16 in the top plate 1 is shown. The safety chain 11, the left pump jack socket 6, the right pump jack socket 8, the left carrying handle 14 and the right carrying handle 15 are depicted. The bottom section of the kg stabilizing plate 10 is shown and is in contact with the top segment of the left leg 12 and the top segment of the right leg 13 that are adapted for attachment to the stuffing box. The leg stabilizing plate 10 has a leg stabilizing plate middle portion 401, a leg stabilizing plate void space 416 and a leg stabilizing plate outer perimeter 400. The length of the leg stabilizing void space 416 comprises the distance from the leg stabilizing plate middle portion 401 to the leg stabilizing plate outer perimeter 400 of the leg stabilizing plate 10, and the width of the leg stabilizing plate void space comprises the distance between the two opposing internal sides of the length of the leg stabilizing plate void space. FIG. 5 further show the overlap of the leg stabilizing void space 416 and the void space 16 of the top plate. In this embodiment of the present invention, the legs are hollow to attach to bolts of the stuffing box.

Figure 6:
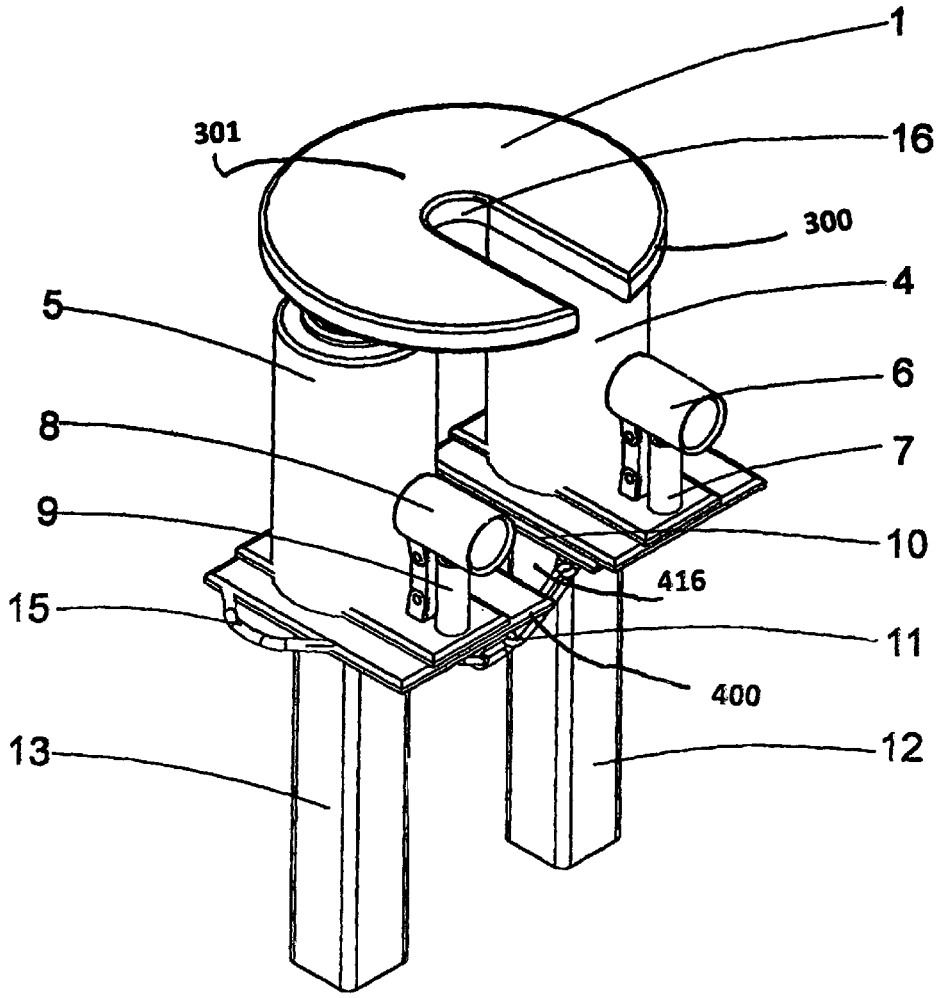
FIG. 6 illustrates a front top right-sided perspective view of one embodiment of the present invention.

FIG. 6 shows a right front top perspective view of one embodiment of the instant invention. Specifically, the top plate 1 is shown and a void space 16 extending from the top plate middle portion 301 to the outer perimeter 300 of the top plate is also shown. The bottom of the top plate 1 is in contact with the top portion of the lifting means. The lifting means comprises left lifting jack 4 and right lifting jack 5. Figure depicts the left jack pump socket 6 and left jack base 7 and right jack pump socket 8 and right jack base 9. Right carrying handle 15 and safety chain 11 are also depicted. The bottom portions of left lifting jack 4 and the right lifting jack 5 are in contact with the top section of the leg stabilizing plate 10. The leg stabilizing plate void space 416 extending to the leg stabilizing plate outer perimeter 400 is also shown. The leg stabilizing plate bottom section is in contact with the top segment of the left leg 12 and the top segment of the right leg 13 that are adapted for attachment to the stuffing box, not depicted.

Figure 7:
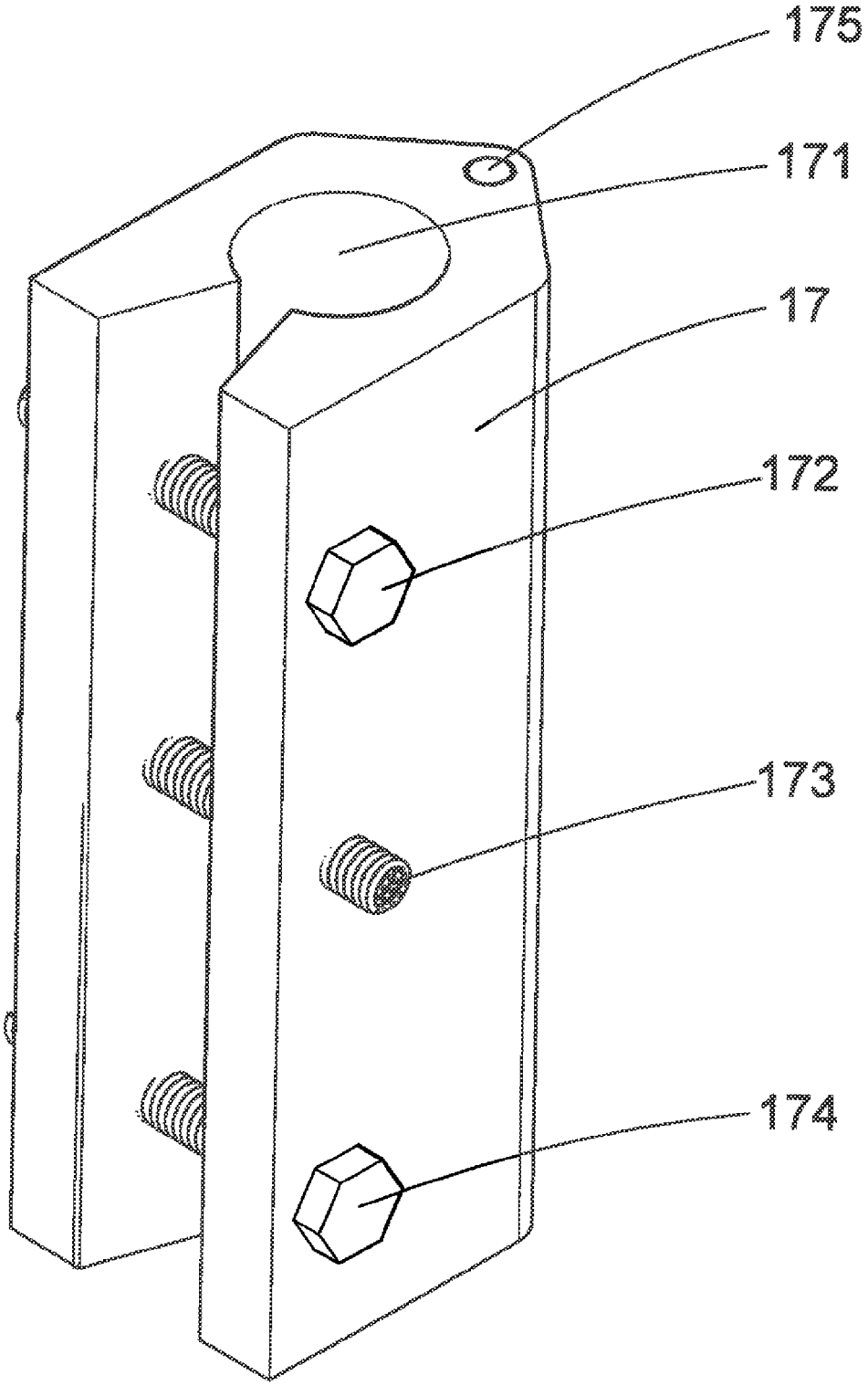
FIG. 7 illustrates a left-side perspective view of a polished rod clamp useful for the practice of an embodiment of the present invention.

FIG. 7 depicts a perspective side view of a temporary polished rod clamp 17 having a hinge 175, an opening 171 to receive the polished rod, not pictured, and a top bolt 172, center bolt 173 and bottom bolt 174 to tighten the polished rod clamp to the polished rod. The bottom surface of the temporary polished rod clamp 17 sets on the top surface of the top plate 1 during use of the invention.

Figure 8:
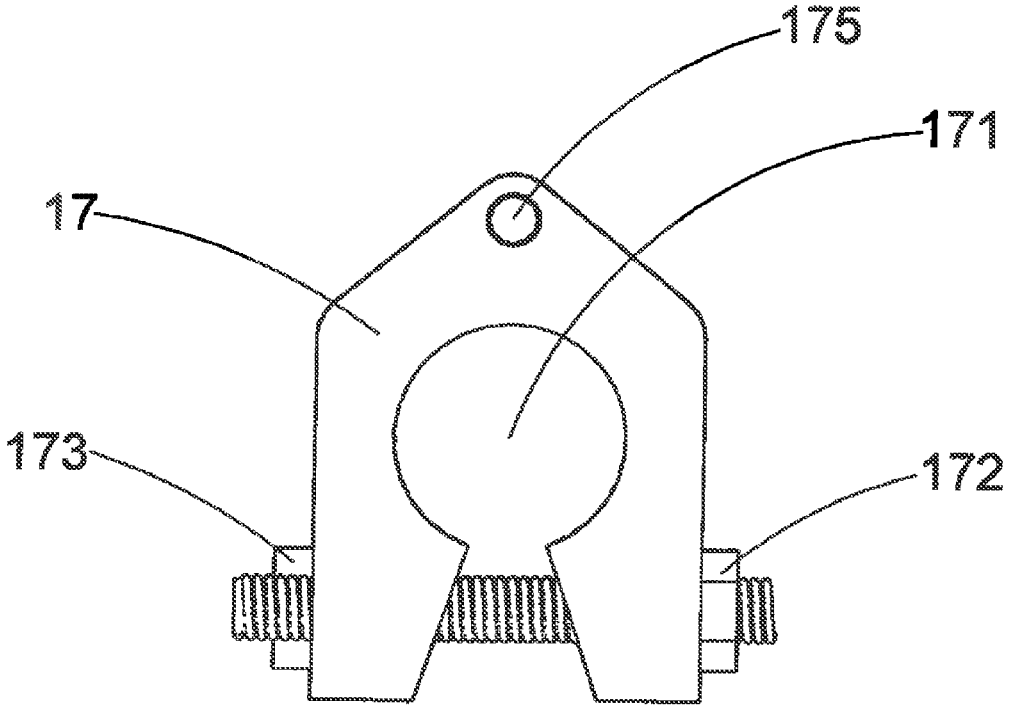
FIG. 8 illustrates a top planar view of a polished rod clamp useful for the practice an embodiment of the present invention.

FIG. 8 depicts a top down planar view of the temporary polished rod clamp 17 showing the opening 171, hinge 175, top bolt 172 and center bolt 173. The polished rod, not pictured, fits into the opening 171 and is securedly attached via tightening of the top, center and bottom bolts.

Figure 9:
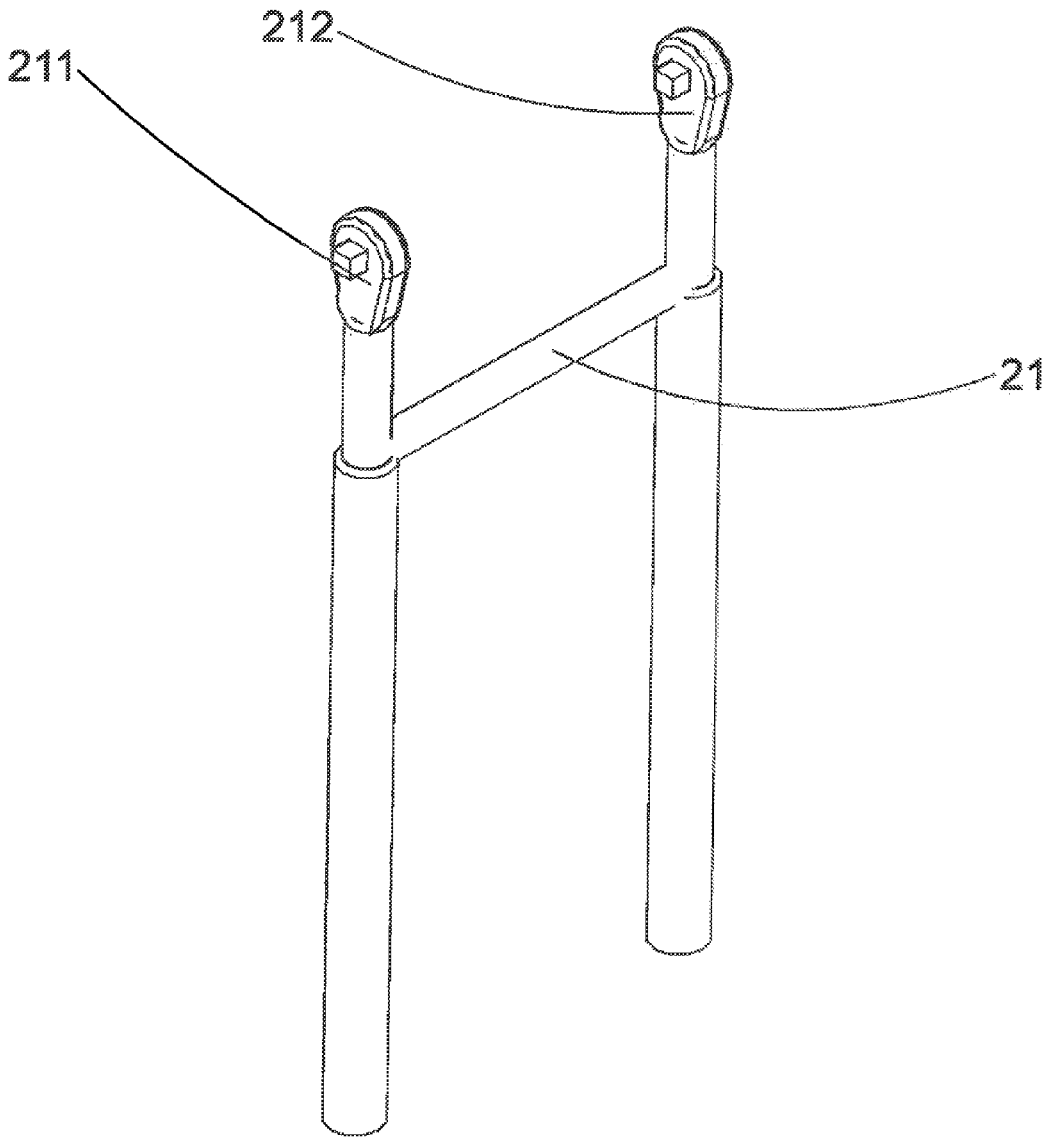
FIG. 9 illustrates a handle useful for practice of an embodiment of the present invention.

FIG. 9 depicts the jack pump handle 21. The ratchets 211 and 212 fit into bleeder ports, not depicted. The bottom portions of the jack pump handle fit into the jack pump sockets 6 and 8, not pictured.

Figure 10:
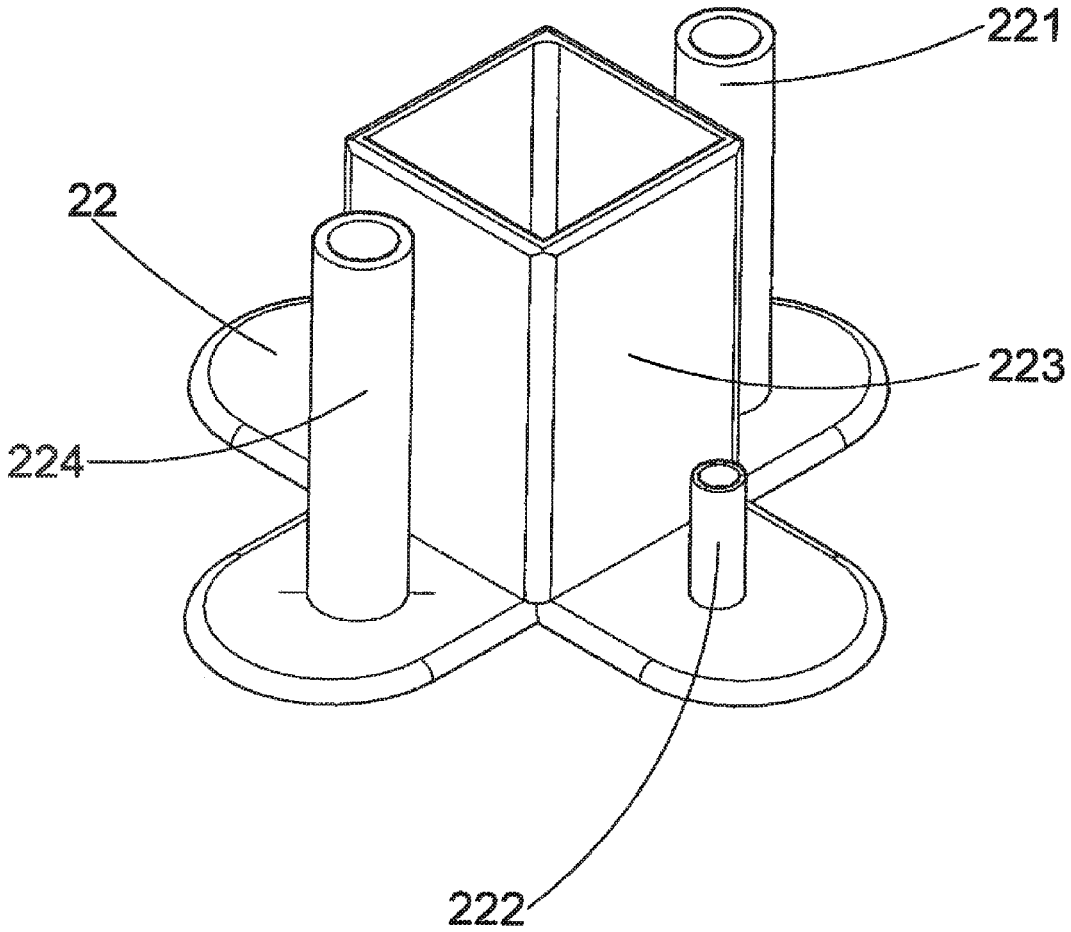
FIG. 10 illustrates a carrying apparatus for transport of the present invention.
Figure 11:
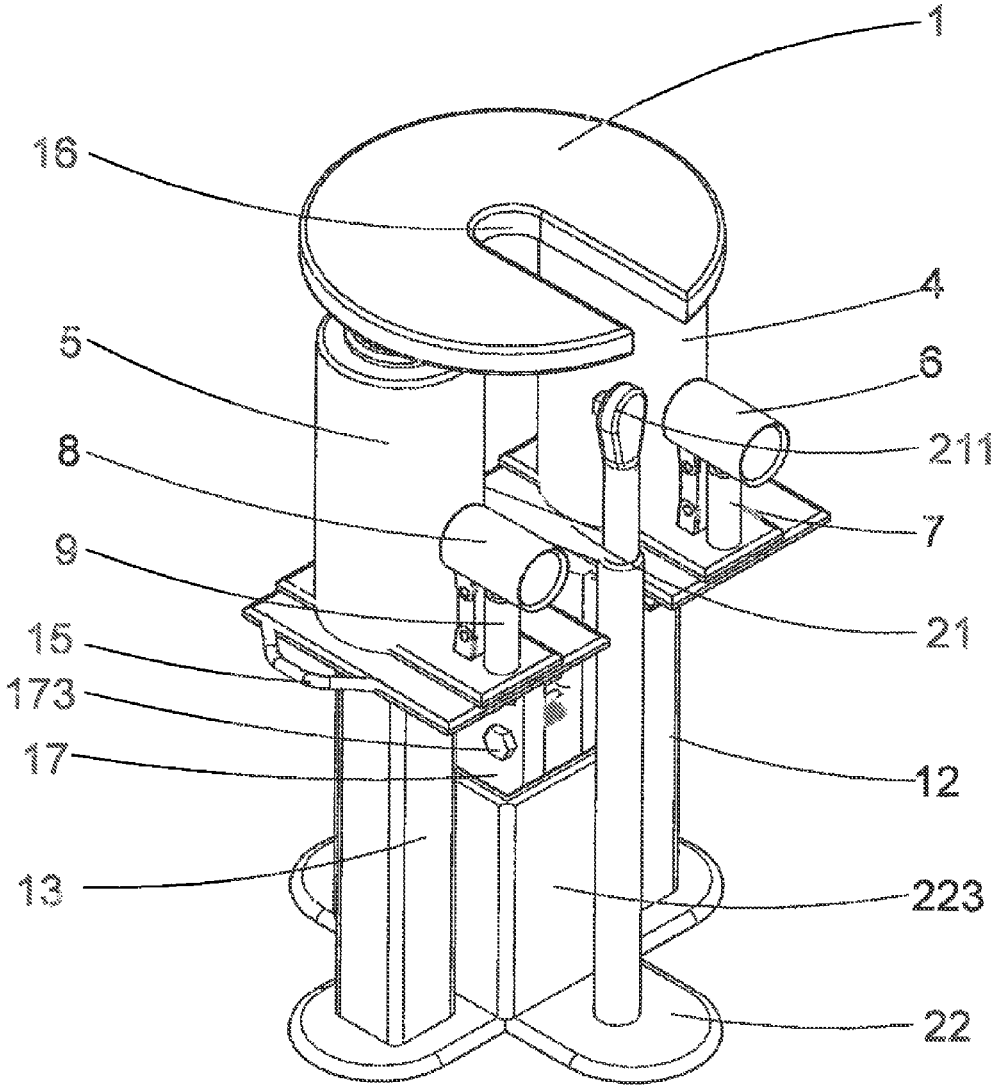
FIG. 11 illustrates one embodiment of the present invention loaded in the carrying apparatus of FIG. 10.

FIG. 10 depicts a carrying apparatus 22 for the instant invention and provides easy transport of the invention. A ratchet receiver 222 is depicted and adapted to receive one of the bottom portions of the ratchet depicted in FIG. 9. It is anticipated, but not depicted, that the opposite side of the stand has a second ratchet receiver to receive the other bottom portion of the ratchet depicted in FIG. 9. Also depicted in FIG. 10 are the leg mounts 224 and 221, which are adapted to receive the legs of the one embodiment of the instant invention as depicted in FIGS. 1-6. FIG. 11 shows one embodiment of the instant invention set in the carrying apparatus 22.

Figure 12:
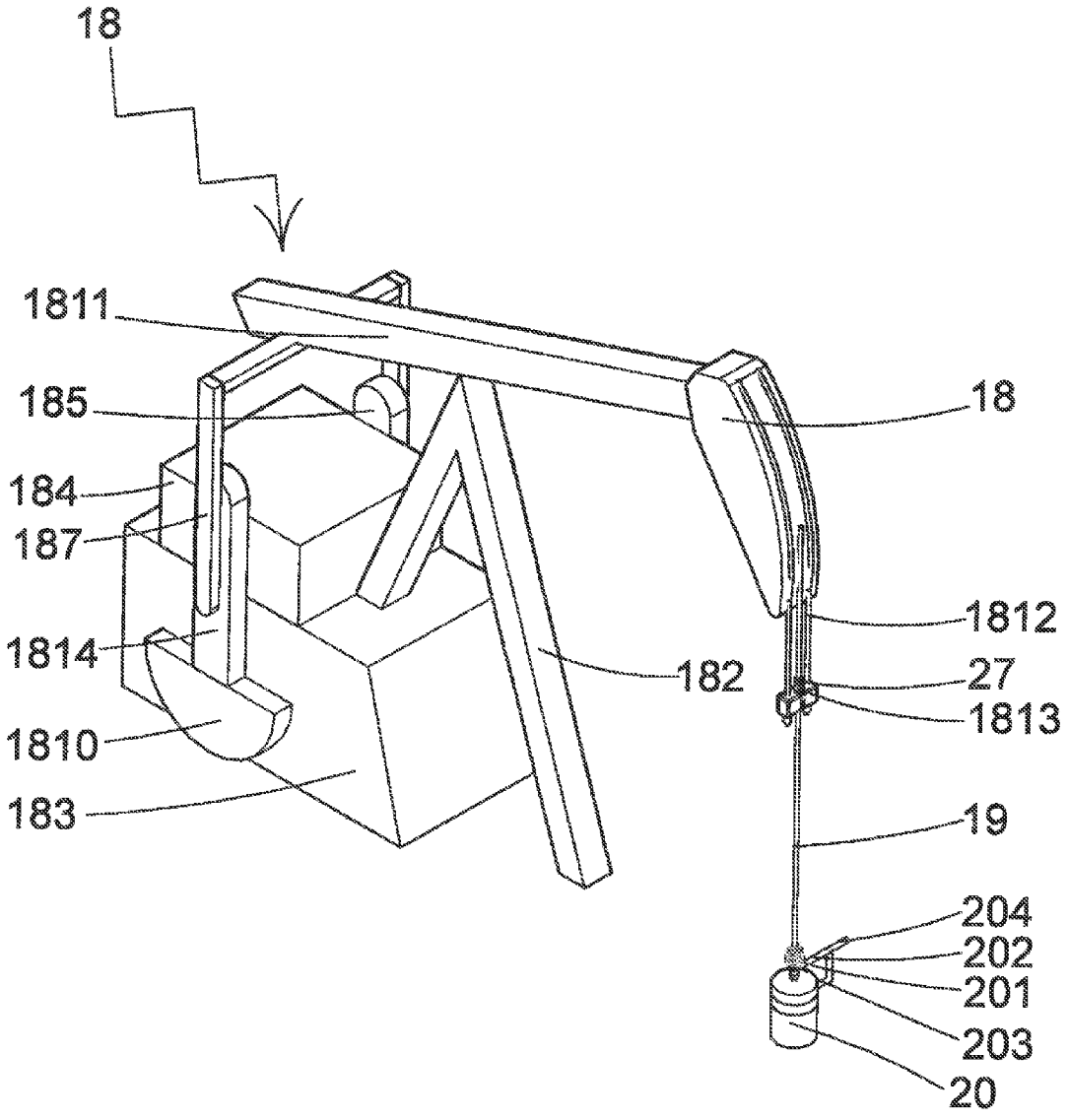
FIG. 12 shows the top portion of a well with the horsehead in the up position.
Figure 13:
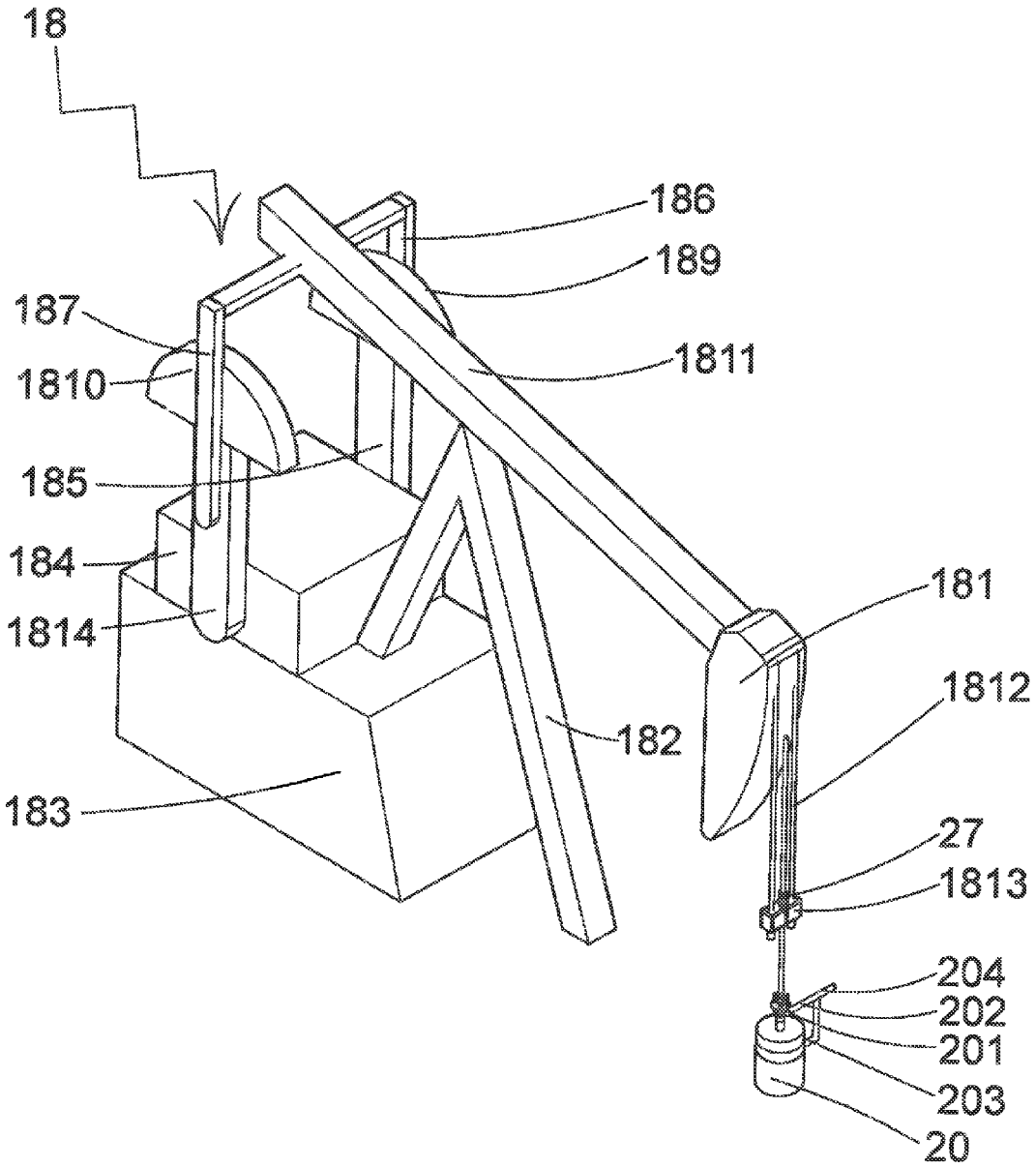
FIG. 13 shows the portion of a well with the horsehead in the down position.

As is well known in the art of water, oil and gas pumping, FIG. 12 depicts a pumping unit 18 having a horsehead 181 in the up position, which has the polished rod 19 at its highest point in elevation during an upward portion of the pump cycle. Also depicted in FIG. 12 are the Samson post 182, pumping unit base 183, pumping unit gear box 184, left crank arm 185, right crank arm 1814, right pitman 187, right counterweight 1810, walking beam 1811, bridal 1812, and carrier bar 1813. Further, the carrier bar 1813 has a polished rod clamp 27 attached to it. In actual pumping operations, there is often additional polished rod clamps attached above the carrier bar. The polished rod clamps maintain attachment of the polished rod 19 during pumping operations as the polished rod plunges into the well head 20 at the stuffing box 201. Also pictured in FIG. 12 is the well casing 203, flow line 204 and tubing 202, FIG. 13, again well known in the water, oil and gas pumping art, depicts the rod lowering portion of the pumping cycle, wherein the horsehead 181 is down and the polished rod is extended its maximum penetration into the well. The same reference characters are used as referenced in FIG. 12, however the left pitman 186 and left counter weight 189 are also depicted.

Figure 14:
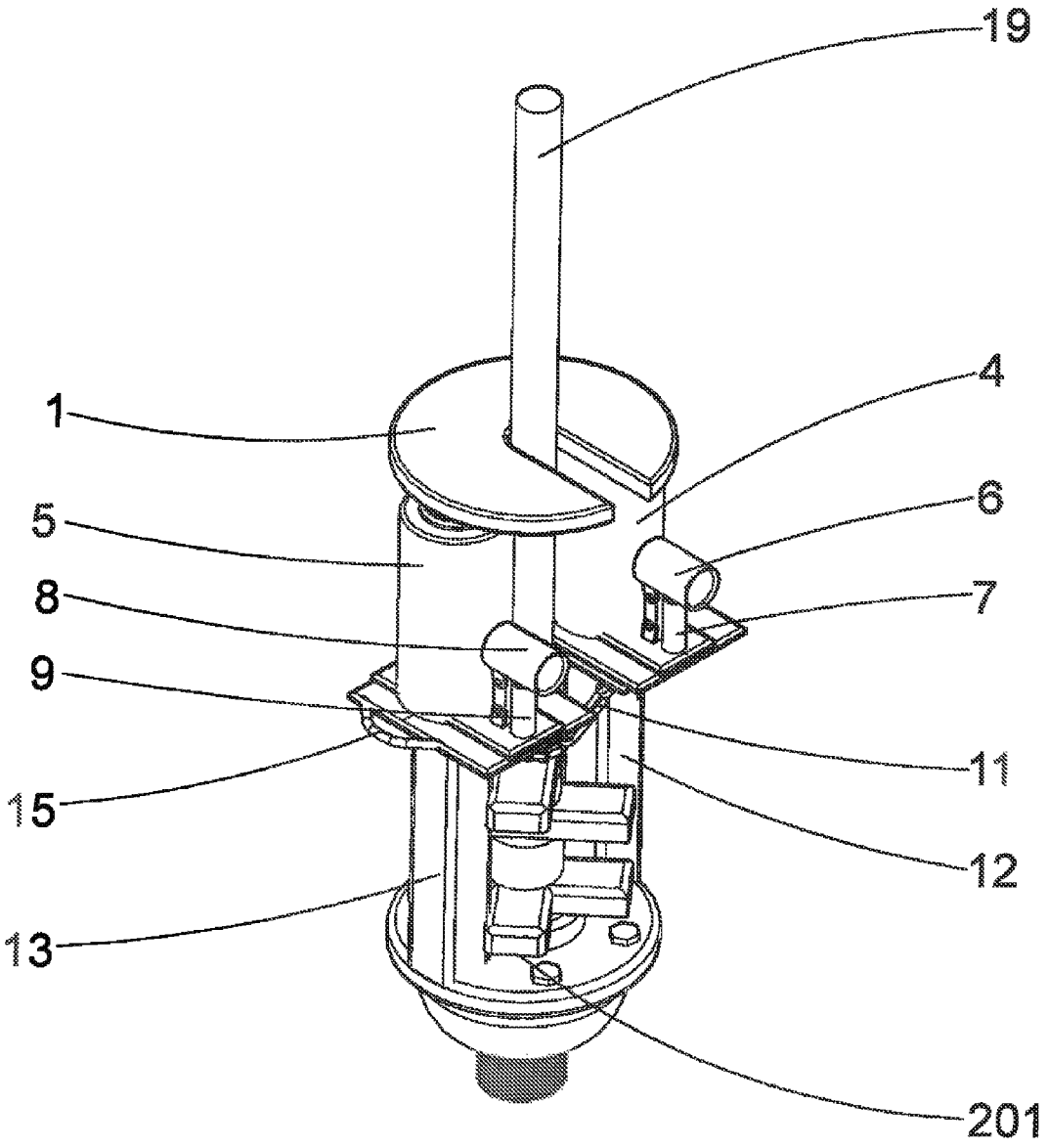
FIG. 14 illustrates the one embodiment of the present invention in a compacted position and at the location of the polished rod without the temporary polished rod clamp attached.

FIG. 14 depicts one embodiment of the instant invention in actual use, wherein the polished rod 19 runs through the top plate 1 and between the lifting jacks 4 and 5 and into the well head stuffing box 201. The lifting jacks are in then most compact condition and the legs 12 and 13 are attached to the stuffing box 201.

Figure 15:
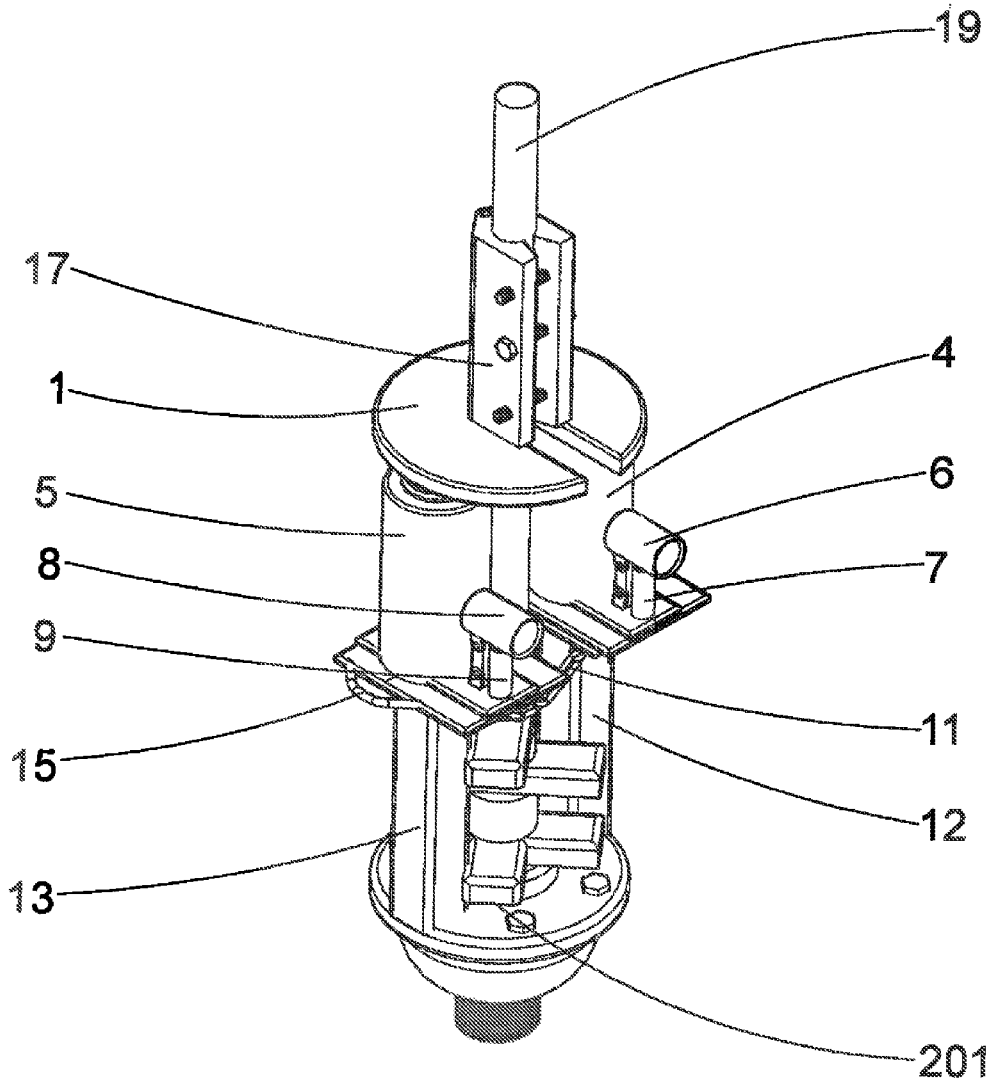
FIG. 15 illustrates the embodiment of the present invention as shown in FIG. 14 at the location of the polished rod with the temporary polished rod clamp attached to the polished rod and the lifting jacks fully compressed.
Figure 16:
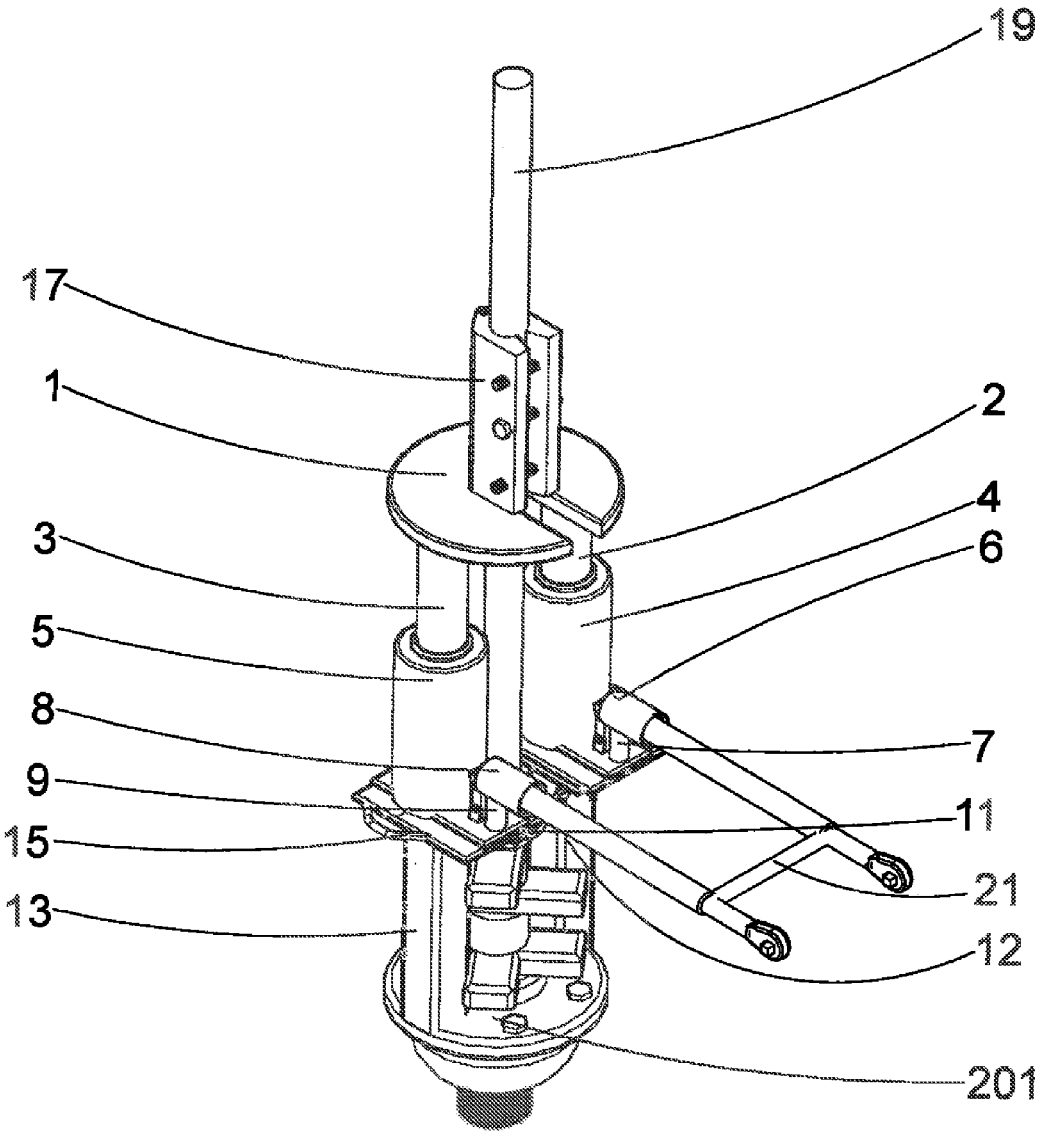
FIG. 16 illustrates one embodiment of the instant invention as the invention is partially compressed and partially extended and the polished rod is partially raised.
Figure 17:
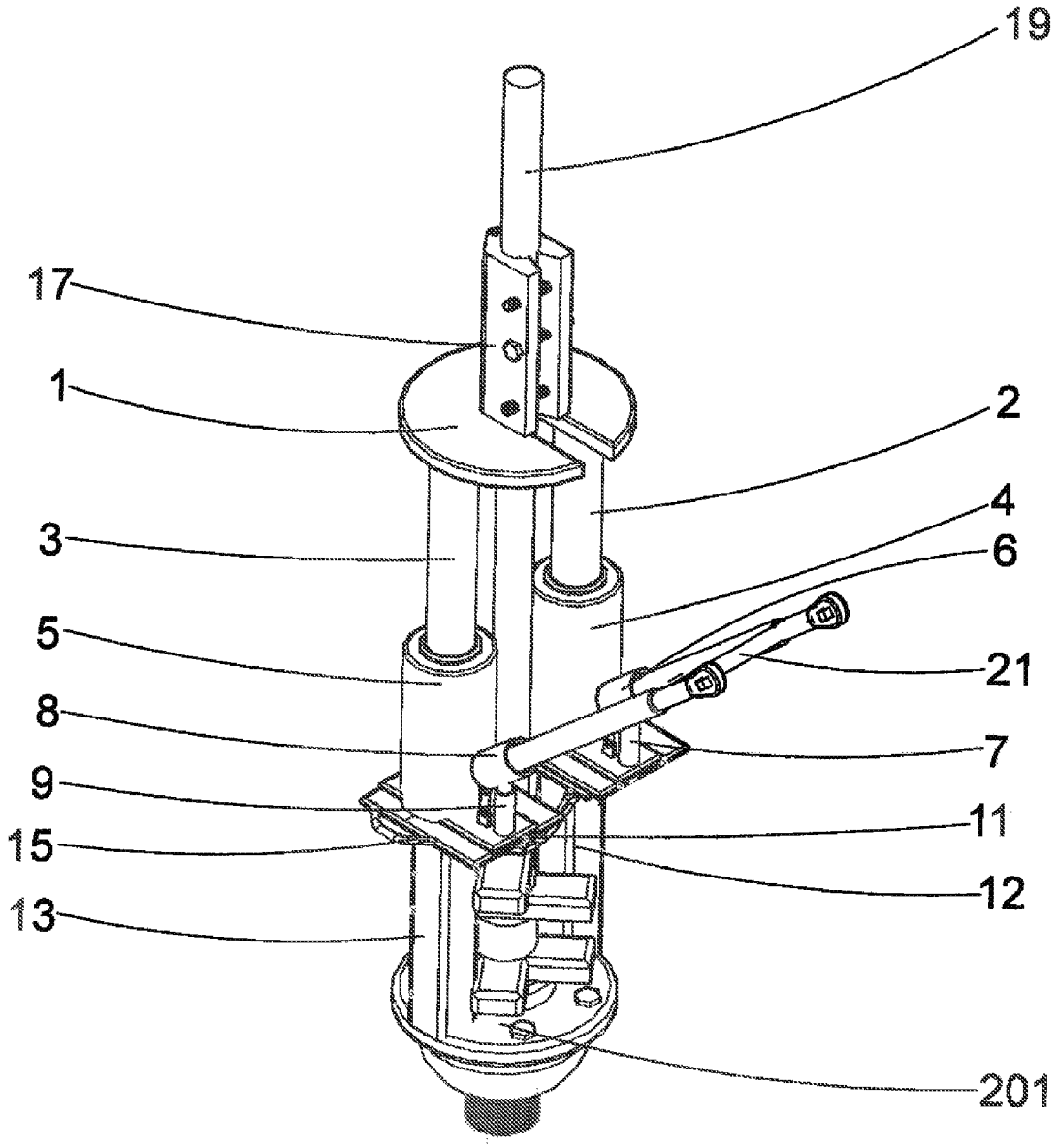
FIG. 17 illustrates a fully extended configuration of one embodiment of the instant invention.

FIG. 15 depicts the temporary polished rod clamp 17 setting atop the top plate 1 and the polished rod clamp securedly attached to the polished rod 19, which extends down into the well through the stuffing box 201. FIG. 16 depicts an intermediate stage of extension of the lifting jacks, produced when the ratchets engage the lifting jacks 4 and 5 via the lifting jack sockets 6 and 8. As the lifting jacks 4 and 5 extend, the top plate 1 is pushed up, which causes the temporary polished rod clamp 17 to be likewise pushed up and because the temporary polished rod clamp 17 is securedly attached to the polished rod 19, the polished rod is raised. FIG. 17 shows full extension of the lifting jacks and therefore full elevation of the polished rod 19, which contains the additional rod components of the well rod string.

Figure 18:
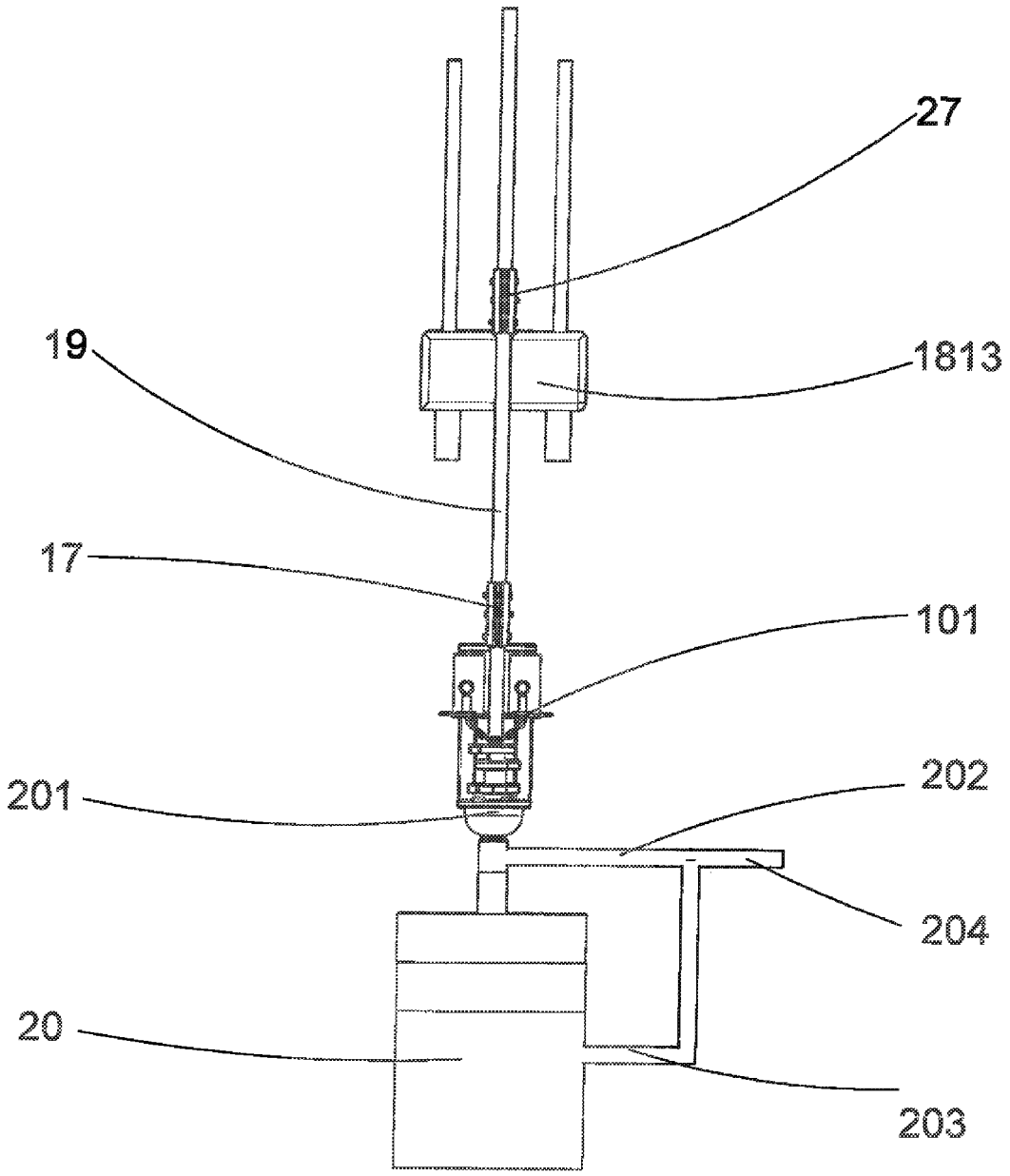
FIG. 18 illustrates one embodiment of the present invention, the well head and pumping unit with the invention configured according to the condition found in FIGS. 14 and 15.

FIG. 18 corresponds to the condition shown in FIGS. 14 and 15, wherein the lifting jacks are in the most compact condition. This most compact condition shows the polished rod clamp 27 securedly attached to the polished rod 19 and sitting atop the carrier bar 1813.

Figure 19:
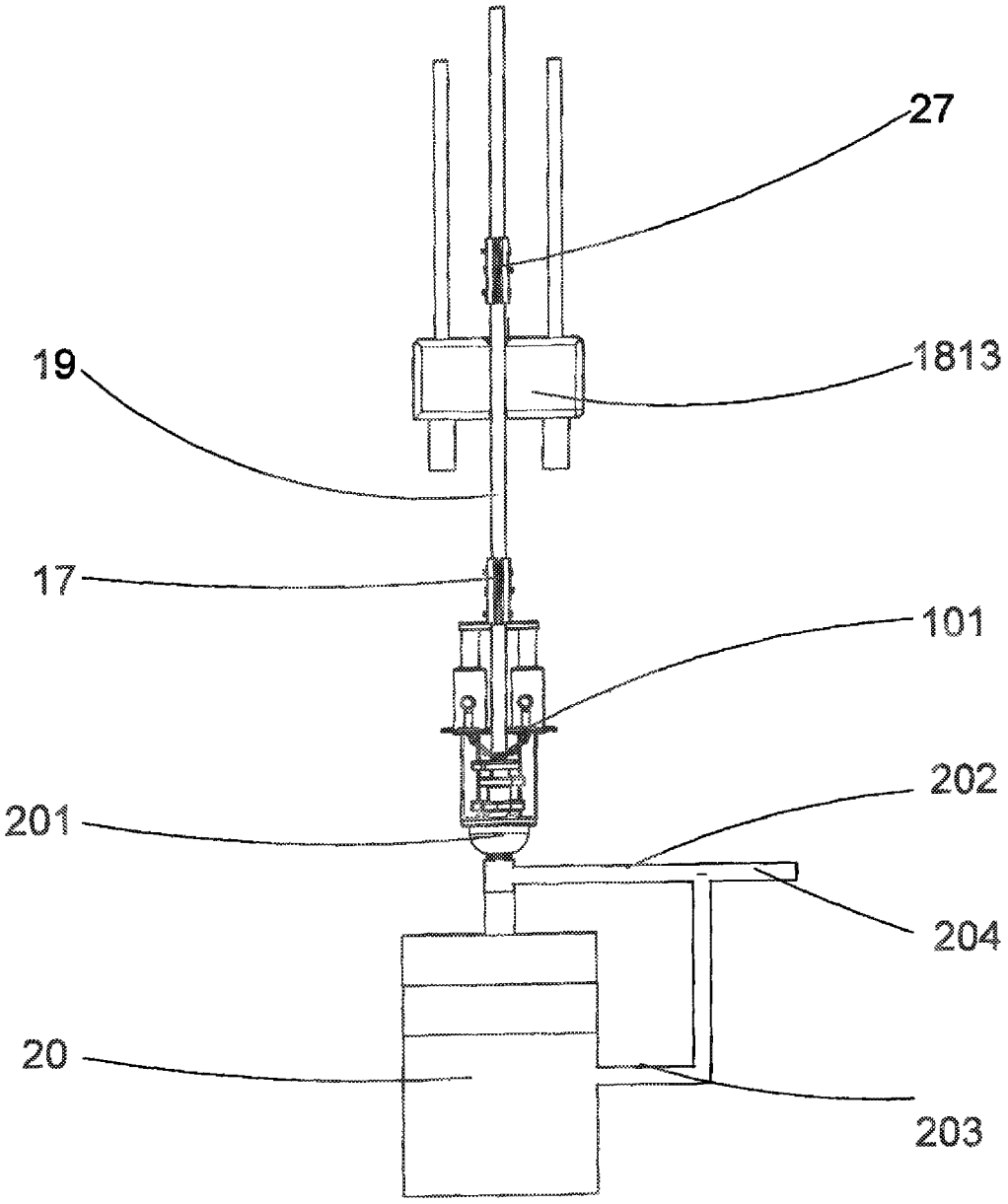
FIG. 19 illustrates one embodiment of the instant invention, the well head and pumping unit with the invention configured according to the condition found in FIG. 16.

FIG. 19 corresponds to the condition shown in FIG. 16, wherein the lifting jacks are in art intermediate stage of extension and the polished rod 19 is being lifted because it is attached to the temporary polished rod clamp 17, which is sitting atop the top plate 1. As the polished rod 19 is being raised, the polished rod clamp 27 is being raised. The carrier bar 1813 is not being raised as the lifting jacks extend because it is not attached to the either the polished rod 19, nor is the carrier bar attached to the polished rod clamp 27.

Figure 20:
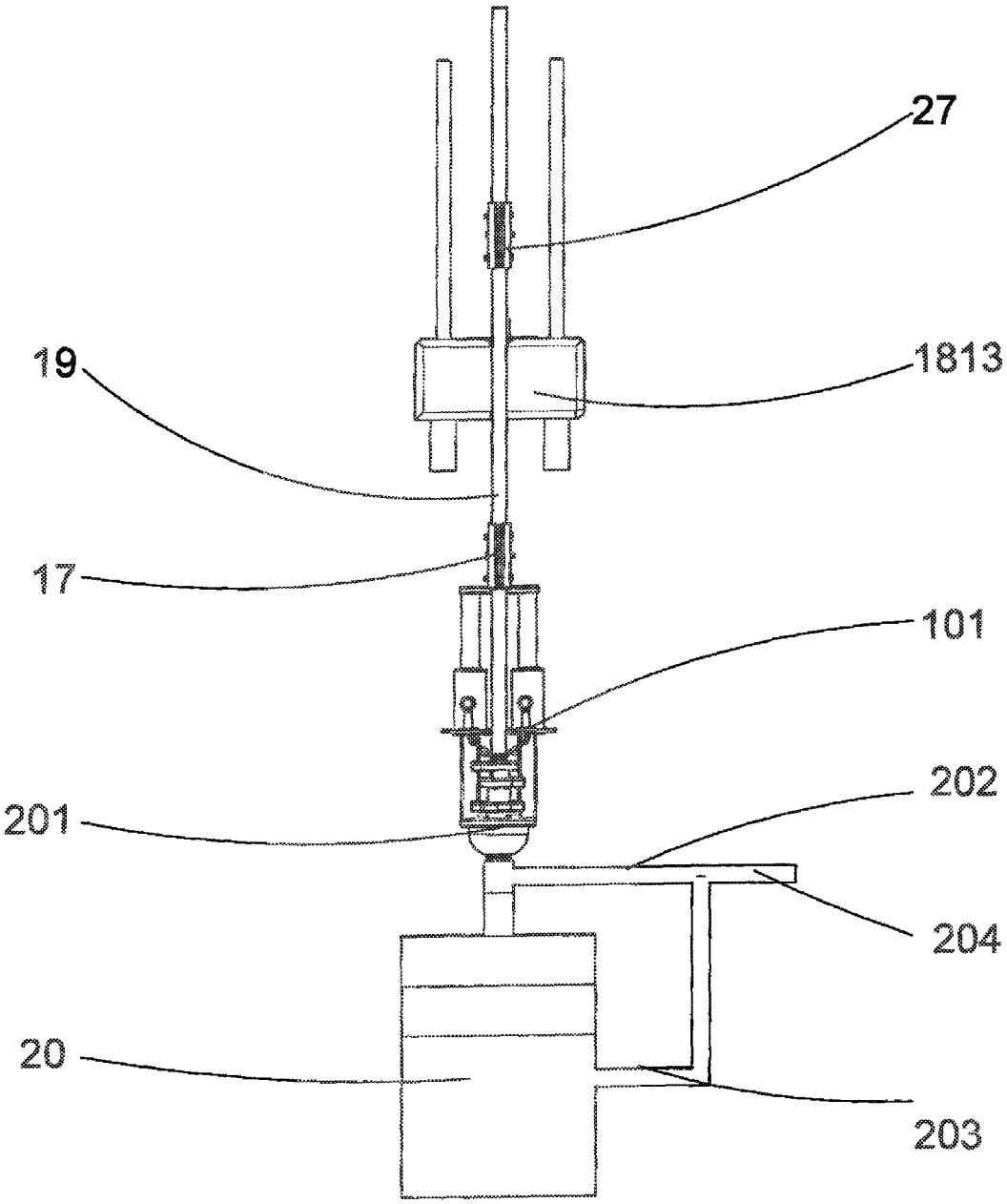
FIG. 20 illustrates one embodiment of the instant invention, the well head and pumping unit with the invention configured according to the condition found in FIG. 17.
Figure 21:
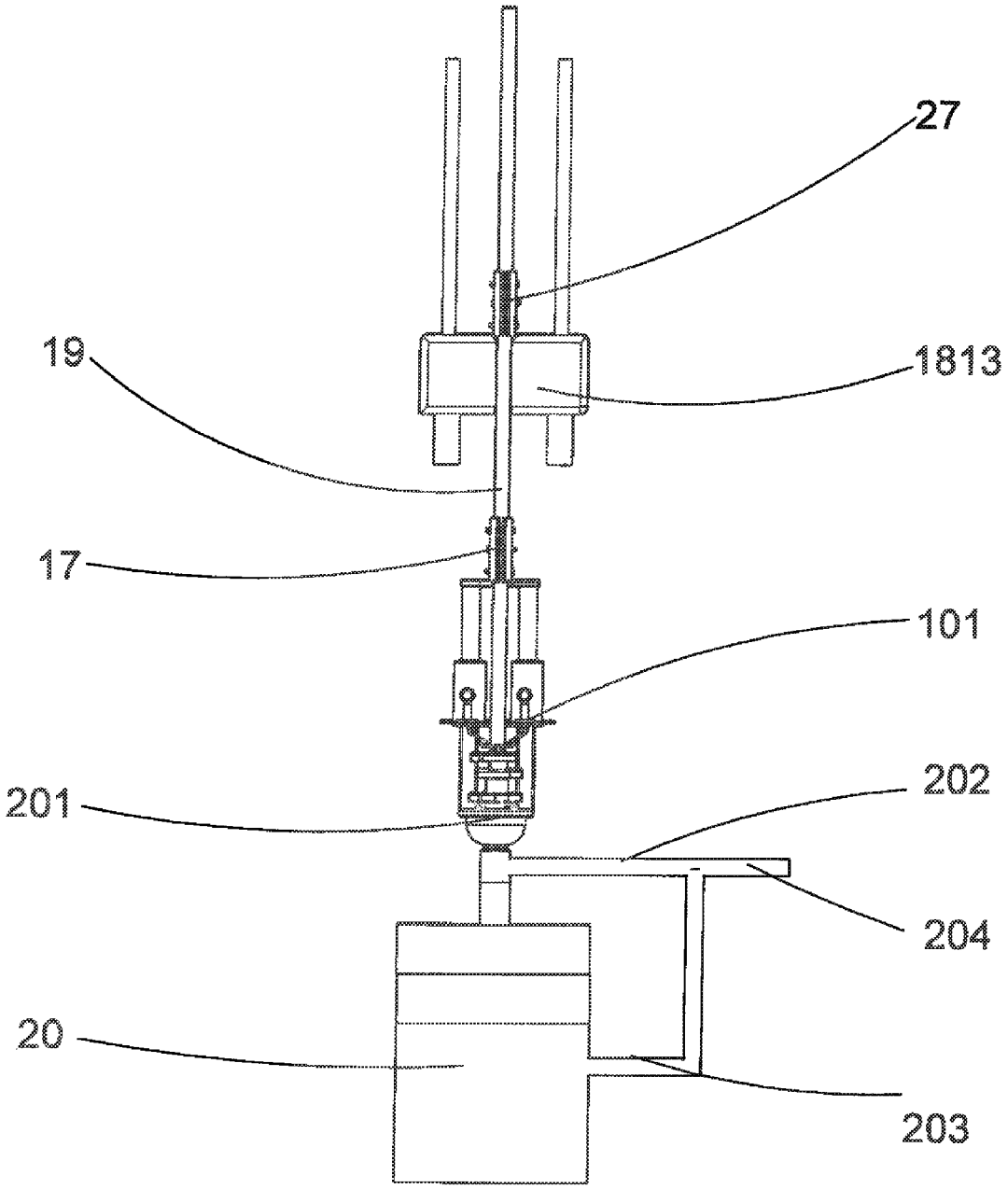
FIG. 21 illustrates manipulation of the polished rod clamp from the position held in FIG. 20.
Figure 22:
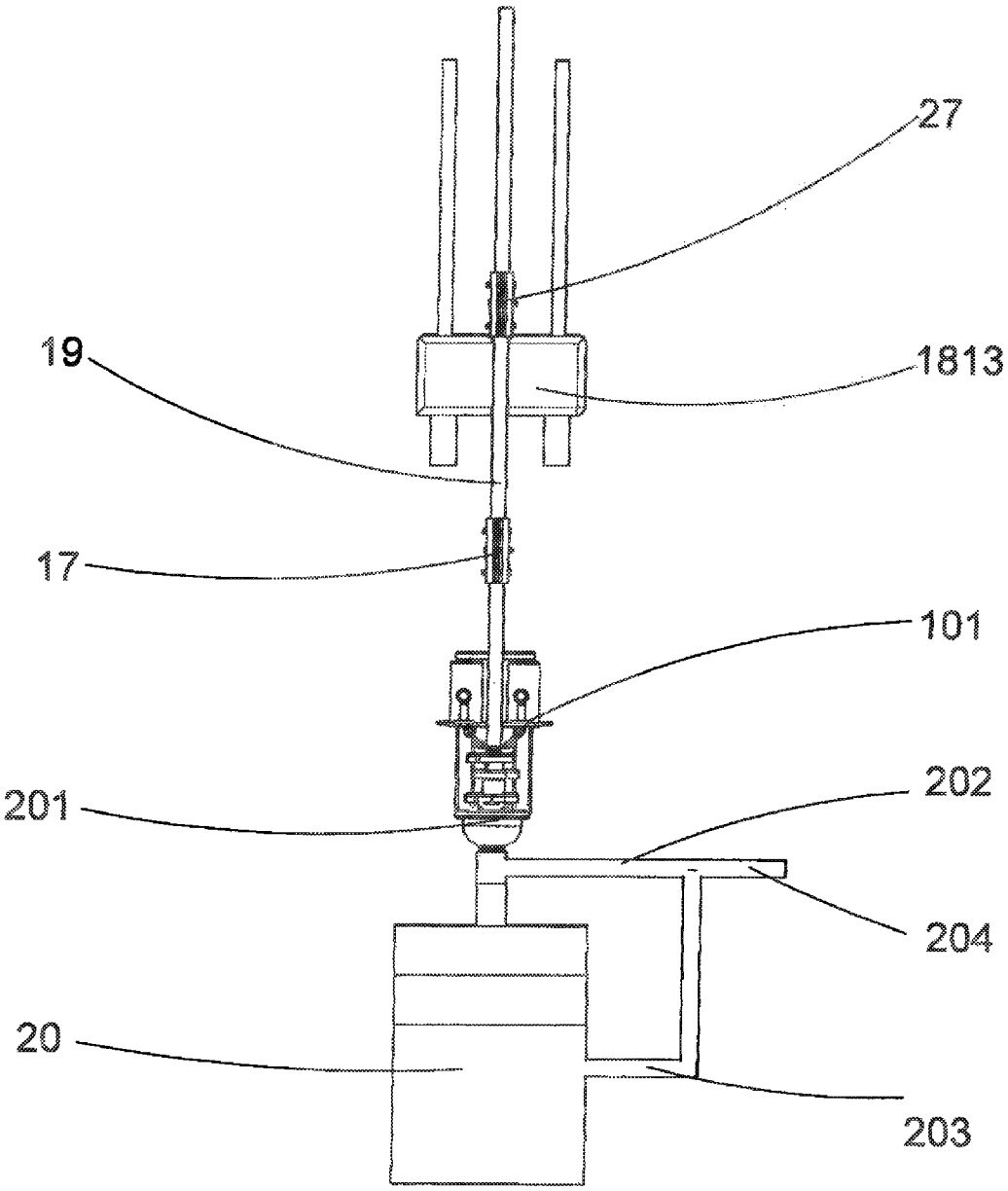
FIG. 22 illustrates compression of one embodiment of the present invention after manipulation shown in FIGS. 20 and 21.

FIG. 20 depicts the full extension of the lifting jacks and corresponds to the condition shown in FIG. 17. The polished rod 19 is no fully lifted due to its attachment to the temporary polished rod clamp 17, which sits atop the top plate 1, which sits atop the lifting jacks 4 and 5. The condition depicted in FIG. 20 no shows significant separation between the carrier bar 1813 and the polished rod clamp 27. In actual use, the polished rod clamp can be detached safely from the polished rod 19 as all the polished rod weight and the weight of the well rod string down the well is being supported by the temporary polished rod clamp 17, sitting atop the top plate 1, which is being held up and fully extended by the lifting jacks 4 and 5. FIG. 21 shows the polished rod clamp 27 attached at a lower position on the polished rod 19 and the polished rod clamp 27 now sitting atop the carrier bar 1813 again. FIG. 22 shows the fall compression of the lifting jacks 4 and 5. The full weight of the polished rod 19 is now held by the earlier bar 1813 and the invention can be removed, The net result of the manipulations shown in FIGS. 14-22 is that the polished rod clamp now grips the polished rod in a lower position. Thus, the polished rod does not penetrate as far into the well. This manipulation was initiated when the horsehead was in the down position. Alternatively, if it was desired to extend the polished rod farther into the well, the condition shown in FIG. 21 would be the same, i.e., having the lifting jacks fully extended, however the polished rod clamp would not be moved closer to the carrier bar, but rather moved further away from the carrier bar and securely attached in such a predetermined position. The lifting jacks would be lowered and, as the polished rod is correspondingly lowered, the polished rod clamp would come into contact with the carrier bar, which would again support the weight of the polished rod and the well rod string and the invention apparatus could be removed. In this instance, the distance of movement up of the polished rod clamp could not exceed the traveling distance of the lifting jack between the fully compressed and fully extended configurations. It is contemplated in this invention that the temporary polished rod clamp and top plate may be integrally formed. Further, it is contemplated within the scope of this invention that any of the temporary polished rod clamp, top plate, lifting means, stabilizing plated and legs may be integrally formed to one another.

It is believed that the apparatus of the present invention and many of its attendant advantages will be understood from the foregoing description. It is also believed that it will be apparent that various changes nay be made in the form, geometry, construction, and arrangement of the components without departing from the scope and spirit of the invention and without sacrificing its material advantages. The forms described are merely exemplary and explanatory embodiments thereof it is the intention of the following claims to encompass and include such changes.

What is claimed is:

1. An apparatus for adjusting vertically a well rod string's penetration into a well by temporary attachment of the apparatus at a well's polished rod above a stuffing box at a well head, said apparatus comprising a top plate, a first lifting jack having a first lifting jack top portion, a first lifting jack bottom portion and a first lifting jack socket, a second lifting jack having a second lifting jack top portion, a second lifting jack bottom portion and a second lifting jack socket, a leg stabilizing plate and at least two or more legs, said top plate having a top surface, a bottom surface, an outer perimeter, a middle portion and a void space that is larger than the polished rod, the bottom surface of the top plate in contact with and disposed above the first lifting jack top portion and the second lifting jack top portion to raise and lower the top plate, said top plate disposed perpendicular to said polished rod and the void space extends from the middle portion of the top plate to the outer perimeter of the top plate, said first and second lifting jacks raise and lower the top plate comprising a top portion and a bottom portion, said first lifting jack top portion and said second lifting jack top portion are in contact with and raise and lower the top plate top portion as said lifting jack top portions are in contact with the bottom surface of the top plate and said first lifting jack bottom portion and said second jack bottom portion are in contact with and raise and lower the top plate bottom portion as said lifting jack bottom portions are in contact with the leg stabilizing plate, said leg stabilizing plate having a top section and a bottom section, said leg stabilizing top section in contact with the bottom portions of the first and second lifting jacks to raise and lower the top plate and said leg stabilizing bottom section in contact with the at least two or more legs, each of said at least two or more legs comprises a top segment and a bottom segment, each of said at least two or more legs top segment are adapted for attachment to the leg stabilizing plate bottom section and each of said at least two or more legs bottom segments are adapted for attachment at the well head.

2. The apparatus of claim 1, wherein the apparatus further comprises a jack pump handle inserted into the first lifting jack socket and the second lifting jack socket.

3. The apparatus of claim 1, further comprising a first handle attached to the leg stabilizing plate and a second handle attached to the leg stabilizing plate.

4. The apparatus of claim 3, wherein the plate void space is adapted to at least partially surround the polished rod.

5. The apparatus of claim 1, further comprising a temporary polished rod clamp having an inner surface adapted for securing attachment to the polished rod, a top, a bottom having an outer perimeter, and an outer surface.

6. The apparatus of claim 5, wherein the void space that is larger than the polished rod is also smaller than the outer perimeter of the bottom surface of the temporary polished rod clamp.

7. The apparatus of claim 5, wherein the top surface of the top plate is in contact with the bottom surface of the temporary polished rod clamp.

8. The apparatus of claim 5, wherein the temporary polished rod clamp and the top plate are integrally formed.

9. The apparatus of claim 1, wherein the first lifting jack and the second lifting jack and the top plate are integrally formed.

10. The apparatus of claim 1, wherein the leg stabilizing plate and the first lifting jack and the second lifting jack are integrally formed.

11. The apparatus of claim 1, wherein the leg stabilizing plate comprises a leg stabilizing plate middle portion, a leg stabilizing plate void space and a leg stabilizing plate outer perimeter and the leg stabilizing plate void space extends from the leg stabilizing plate middle portion to the leg stabilizing plate outer perimeter.

12. An apparatus for adjusting vertically a well rod string's penetration into a well by temporary attachment of the apparatus at a well's polished rod above a stuffing box at a well head, said apparatus comprising a temporary polished rod clamp, a top plate, a first lifting jack having a first lifting jack top portion, a first lifting jack bottom portion and a first lifting jack socket, a second lifting jack having a second lifting jack top portion, a second lifting jack bottom portion and a second lifting jack socket, a leg stabilizing plate and at least two or more legs, said temporary polished rod clamp having an inner surface adapted for securing attachment to the polished rod, a top, a bottom, and an outer surface, said top plate having a top surface, a bottom surface, an outer perimeter, a middle portion and a void space that is larger than the polished rod and smaller than the bottom surface of the temporary polished rod clamp and the void space extends from the middle portion of the top plate to the outer perimeter of the top plate, the top surface of the top plate in contact with the bottom surface of the temporary polished rod clamp, the bottom surface of the top plate in contact with and disposed above the first lifting jack top portion and the second lifting jack bottom portion, said top plate disposed perpendicular to said polished rod, said first lifting jack and said second lifting jack and said first lifting jack and said second lifting jack raise and lower the top plate bottom portion in contact with the leg stabilizing plate, said leg stabilizing plate having a top section and a bottom section, a leg stabilizing plate middle portion, a leg stabilizing plate void space and a leg stabilizing plate outer perimeter and the leg stabilizing plate void space extends from the leg stabilizing plate middle portion to the leg stabilizing plate outer perimeter, said leg stabilizing top section in contact with the bottom portion of the first lifting jack and said second lifting jack and said leg stabilizing bottom section in contact with the at least two or more legs, each of said at least two or more legs comprising a top segment and a bottom segment, each of said at least two or more legs top segment adapted for attachment to the leg stabilizing bottom section and each of said at least two or more legs bottom segment adapted for attachment to the stuffing box at the well head.

13. The apparatus of claim 12, apparatus further comprises a jack pump handle inserted into the first lifting jack socket and the second lifting jack socket.

14. The apparatus of claim 12, further comprising a first handle attached to the leg stabilizing plate and a second handle attached to the leg stabilizing plate and a chain attached to the first handle and the second handle.

15. The apparatus of claim 12, wherein the void space of the top plate is adapted to at least partially surround the polished rod.

16. The apparatus of claim 15, wherein the void space of the top plate is adapted such that the temporary polished rod clamp sits atop the top plate and the top plate supports the temporary polished rod clamp.

17. The apparatus of claim 12 wherein the temporary polished rod clamp and the top plate are integrally formed.

18. A method to raise or lower a well rod string having a polished rod clamp resting atop a carrier bar and attached to a the polished rod, said method comprising the steps of lowering a horsehead of a pumping unit, affixing an apparatus comprising a temporary polished rod clamp, a top plate having a top surface, a bottom surface, an outer perimeter, a middle portion and a void space that is larger than the polished rod and smaller than the bottom surface of the temporary polished rod clamp and the void space extends from the middle portion of the top plate to the outer perimeter of the top plate, a first lifting jack having a first lifting jack top portion, a first lifting jack bottom portion and a first lifting jack socket, a second lifting jack having a second lifting jack top portion, a second lifting jack bottom portion, a second lifting jack socket and a jack pump handle inserted into the first lifting jack socket and the second lifting jack socket, a leg stabilizing plate and legs attached to the top portion of a well head, attaching the polished rod clamp to the polished rod, raising the polished rod clamp, adjusting the position of the polished rod clamp is affixed to the polished rod, lowering the first lifting jack top portion and the second lifting jack top portion to raise and lower the top plate and removing the apparatus from atop the well head.

19. The method of claim 18, wherein the adjustment of the position of the polished rod clamp step comprises moving the polished rod clamp closer to the carrier bar.

20. The method of claim 18, wherein the adjustment of the position of the polished rod clamp step comprises moving the polished rod clamp further from the carrier bar.

* * * * *